US005405213A

United States Patent [19]

O'Connor

[11] Patent Number: 5,405,213

[45] Date of Patent: Apr. 11, 1995

[54] METHOD OF REPAIRING CRACKS IN ASPHALTIC ROADS

[75] Inventor: Patrick L. O'Connor, Dryden, Mich.

[73] Assignee: Thermal Power Corporation, Almont, Mich.

[21] Appl. No.: 75,998

[22] Filed: Jun. 14, 1993

Related U.S. Application Data

[63] Continuation-in-part of Ser. No. 715,315, Jun. 13, 1991, abandoned, which is a continuation of Ser. No. 569,743, Aug. 20, 1990, abandoned, which is a continuation of Ser. No. 180,995, Apr. 13, 1988, abandoned.

[51] Int. Cl.[6] ..... E01C 7/06

[52] U.S. Cl. ..... 404/77; 404/107

[58] Field of Search ..... 404/77, 78, 80, 82, 404/95, 107

[56] References Cited

U.S. PATENT DOCUMENTS 1,230,894 6/1917 Harrop .
3,970,404 7/1976 Benedetti .
4,084,915 4/1978 Wiseblood .
4,815,891 3/1989 O'Connor .

FOREIGN PATENT DOCUMENTS 831392 3/1960 United Kingdom .

OTHER PUBLICATIONS

Sales Literature of Blackwell Burner Co.

*Primary Examiner*—Michael Powell Buiz
*Assistant Examiner*—James A. Lisehora
*Attorney, Agent, or Firm*—Basile & Hanlon

[57] ABSTRACT

A full depth thermal crack in an asphaltic pavement is repaired by spraying a first rejuvenating agent into the sides of the crack and over the top portion of the asphalt pavement surrounding the crack, heating the top portion of the asphalt to a predetermined temperature greater than 700° F., scarifying the heated asphalt, adding an asphaltic rejuvenating/emulsion agent to the heated, scarified asphalt, compacting the heated, scarified asphalt into the crack for the full depth of the crack wherein heat in the asphalt added to the crack is transferred to the asphalt surrounding the crack to raise the temperature of the surrounding asphalt sufficient to form a homogeneous bond between the original and new asphalt added to the crack. In a preferred embodiment, the heated, scarified asphalt is added in predetermined quantities into the crack so as to fill the crack only to a predetermined depth and then compacted before additional quantities of asphalt are added and compacted in subsequent steps.

7 Claims, 2 Drawing Sheets

METHOD OF REPAIRING CRACKS IN ASPHALTIC ROADS

CROSS REFERENCE TO CO-PENDING APPLICATION

This application is a continuation-in-part application of United States patent application Ser. No. 07/715,315, filed Jun. 13, 1991, in the name of Patrick L. O'Connor, now abandoned, which was a continuation of U.S. patent application Ser. No. 07/569,743, filed Aug. 20, 1990, now abandoned, which itself was a continuation of U.S. patent application Ser. No. 07/180,995, filed Apr. 13, 1988, now abandoned.

BACKGROUND OF THE INVENTION

The present invention relates, in general, to methods of repairing asphaltic roads, airport runways and the like and, more specifically, to methods for repairing deep, thermal cracks and/or cold joints in asphaltic roads, airport runways and the like.

Description of the Art

Asphaltic roads including asphalt airport runways have a tendency over time to crack due to weathering and internal stresses of the asphaltic material. In the past, when a crack has occurred in the surface of a road or runway, a thermoplastic sealant would be inserted into the crack to attempt to seal the crack. The difficulty with this technique is that the thermoplastic material that is inserted into the crack has a tendency itself to become less thermoplastic and to shrivel or shrink thereby exposing the interior of the crack. Once this has occurred, the weathering that would normally occur and the freezing and thawing of the asphaltic surface and roadway would further deteriorate the asphalt surrounding the crack. Such deterioration would decrease the useful life of the roadway.

A method of reconstructing asphalt pavement as disclosed in U.S. Pat. No. 3,970,404 which uses a series of heat application steps to soak heat into the top layer of the asphaltic surface to a predetermined depth of approximately one inch. The softened asphalt is then scarified and subsequently compacted or leveled into a new trafficable surface. A radiant heater is used to provide suitable amounts of heat to soften the asphalt. This patent discloses the generally known heating characteristic of asphaltic roadways where the surface of the asphalt pavement should be heated to a temperature within the range of 225° F. to about 325° F. This is due to the fact that asphalt deteriorates at temperatures above 350° F. As a result, only the top one to one and a quarter inches of the asphalt roadway are heated and softened by this technique thereby permitting only repair of the top one to one and a quarter inch of asphalt roadway.

U.S. Pat. No. 4,084,915 discloses a similar method for reconditioning and resurfacing pavement in which a bituminous liquid or rejuvenating agent is sprayed over the area to be repaired. An infrared heater is passed over the pavement heating the bituminous liquid and the top surface of the asphalt to a temperature of approximately 225° F. to soften the upper surface of the pavement. Mechanical choppers are then used to break up the softened pavement down to a depth of approximately one inch. Power operated mechanical mixers are then employed to mix and fully integrate the disintegrated bituminous concrete or asphalt with the bituminous liquid. Once this is done, a screed is passed over the asphalt to level the surface of the roadway. This method is suited for resurfacing large areas of asphalt roadway down to a depth of approximately one inch.

U.S. Pat. No. 1,230,894 discloses another method of repairing asphalt pavements in which a flammable solvent is impregnated in the area surrounding a crack in an asphalt surface. The solvent is ignited to soften the asphalt and to form a flux with new material which is added to the crack and the top layer of asphalt. However, only the top layer of asphalt can be impregnated with the flammable solvent such that only asphalt down to a depth of approximately one inch will be softened by the igniting of the flammable solvent. Further, the use of such flammable solvents is known to deteriorate the characteristics of asphalt since the temperature of the asphalt is raised above 350° F.

The above-described methods of repairing cracks in asphaltic pavement or roadway are usable with small depth cracks extending down to one and one and a quarter inches since this is the maximum possible depth of asphalt which can be heated to a softened state at a temperature of 325° F. to 350° F. Such methods are totally ineffective in repairing full depth cracks extending the full or substantially through the six to eight inch depth of a standard asphalt pavement layer down to the underlying bedrock or ground. Such cracks are known as "thermal cracks" which are caused by the expansion and contraction of the pavement and the ground underneath it. Such full depth cracks can also include a crack caused by a cold joint. This type of crack occurs where the asphalt previously installed by the paver in 12 foot widths is cool when the adjacent 12 foot width is added. This places the hot asphalt edge against a cold asphalt edge creating a "cold joint". Such joints can be as wide as a thermal crack and can run from one half inch to six inches in width as well as extending the full six to eight inch depth of the asphalt pavement.

The above-described methods of repairing cracks in asphalt pavement are not effective in repairing full depth thermal cracks or cold joints extending a considerable distance through the asphalt pavement since the temperature of the top one to one and a quarter inch layer of asphalt which has been heated to a softened state is not sufficiently high enough when the heated asphalt is inserted into a full depth crack to form a homogeneous weld with the portions of the asphalt pavement surrounding the crack at the lower regions of the full depth crack. Due to the known practice in the industry of heating asphalt only to a temperature of 325° F. to 350° F. to prevent deterioration of the asphalt, such methods are incapable of repairing full depth thermal cracks or cold joints extending completely or substantially through six to eight inches of an asphalt pavement.

Thus, it would be desirable to provide a method for repairing cracks in asphaltic roads in which heated asphalt material inserted into the crack form a homogeneous weld with the surrounding asphalt material even where the crack extends the full depth or substantially through the full six to eight inches of the asphalt pavement. It would also be desirable to provide a method for repairing full depth cracks in asphaltic pavement which is simple in application.

SUMMARY OF THE INVENTION

The present invention is a method of repairing cracks in asphaltic surfaces and, more particularly, a method for repairing full depth cracks extending six to eight inches or more through an asphalt pavement.

The method comprises the steps of:

1. spraying an asphaltic rejuvenating liquid agent into the sides of a crack for substantially the full depth of the crack and over the portions of the asphalt pavement surface immediately surrounding the edges of the crack;

2. heating the top portion of the asphalt pavement surrounding the crack to a temperature greater than 700° F.;

3. scarifying the heated asphalt immediately adjacent the crack;

4. adding an asphaltic rejuvenating/emulsion agent to the scarified heated asphalt;

5. compacting the heated asphalt and the asphaltic rejuvenating/emulsion agent into the full depth of the crack wherein the heated asphalt transfers heat to the asphalt surrounding the crack to raise the temperature of the asphalt surrounding the crack so as to form a homogeneous bond between the heated asphalt and the asphalt surrounding the crack.

Depending on the depth of the crack, the compacting of the heated, scarified asphalt and the asphaltic rejuvenating/emulsion agent preferably takes place in several steps during which only a predetermined depth, such as three inches, of the scarified, heated asphalt is compacted into the crack in each step.

Finally, additional asphalt may be added to the asphalt pavement surrounding the crack and leveled to form a trafficable road surface.

The method of the present invention uniquely enables thermal cracks or cold joints in asphalt pavement which extend substantially the full depth, such as six to eight inches, of the asphalt pavement to be easily repaired. The present method ensures that the heated, scarified asphalt removed from the top portions of the pavement surrounding the crack is raised to a sufficiently high temperature so as to form a homogeneous bond with the original asphalt surrounding the crack when the heated, scarified asphalt is driven under force into the crack. Since the asphalt is heated to a temperature greater than 700° F., it is at a sufficiently high temperature so as to transfer a portion of such heat into the original asphalt surrounding the crack as such heated, scarified asphalt is driven into the crack. This enables the heated, scarified asphalt to unite and homogeneously bond with the original asphalt to form a continuous, homogeneous asphalt layer through the original asphalt and the asphalt filled into the crack.

By using radiant heating, the Applicant is capable of raising the temperature of the asphalt to a temperature much higher than that previously used in the asphalt pavement industry which generally take the position that asphalt could not be heated to more than 325° F. to 350° F. without any deterioration in the characteristics of the asphalt. However, Applicant overcomes any such deterioration which may occur by raising the asphalt to a temperature greater than 700° F. by adding an asphaltic rejuvenating/emulsion agent after the asphalt has been heated to a temperature greater than 700° F. which overcomes any deterioration in the characteristics of the heated asphalt and, at the same time, enables such asphalt to readily unite with the original asphalt surrounding the crack.

DESCRIPTION OF THE DRAWING

The various features, advantages and other uses of the present invention will become more apparent by referring to the followed detailed description and drawing in which.

DESCRIPTION OF THE PREFERRED EMBODIMENTS

Figure 1:
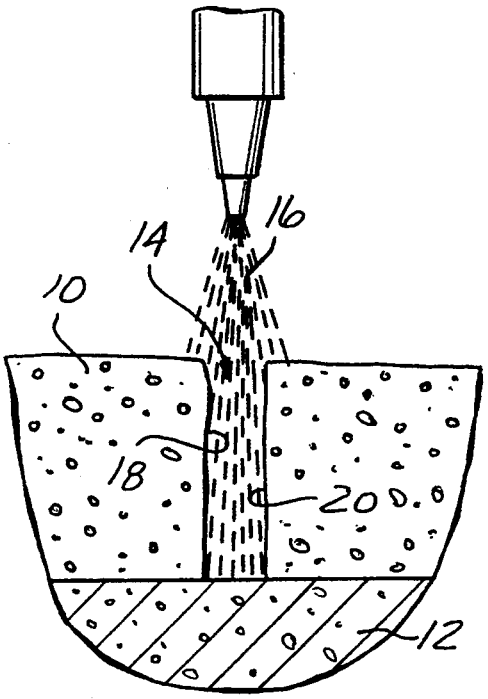
FIG. 1 is a schematic, cross sectional view of a full depth crack in an asphalt roadway showing the application of a liquid rejuvenating agent thereto according to the method of the present invention.

The present invention is a method for repairing full depth cracks in asphaltic pavement, such as roadways, airport runways and the like. As shown in FIG. 1, such asphaltic pavements 10 comprise a layer of asphalt of a predetermined depth, such as six to eight inches or more, which is placed on top of a gravel substrate or road bed 12. Thermal cracks or cold joints 14 are formed in the full depth of the asphalt pavement 10 due to thermal expansion and contraction of the asphalt pavement 10 and the underlying road bed 12. Such cracks 14 could also be formed as a cold joint when a hot layer of asphalt pavement is placed adjacent to a cold layer thereby forming an insufficient bond between the two sections of pavement.

According to the method of the present invention, the first step of the present method comprises the application or spraying of an asphalt rejuvenating agent, such as a rejuvenating liquid 16, into the crack 14 to cover all exposed surfaces 18 and 20 of the original asphalt pavement 10 surrounding the crack 14, as well as on the top surface of the portions of the asphalt pavement 10 surrounding the top portion of the crack 14. While any liquid, petroleum-based rejuvenating material can be utilized as the rejuvenating agent, exemplary rejuvenating agents include RECLAMITE, a trademark of Witco Chemical, Golden Bear Division, Bakersfield, Calif., and ARA-1sold by DAI of Springfield, Ohio.

Figure 2:
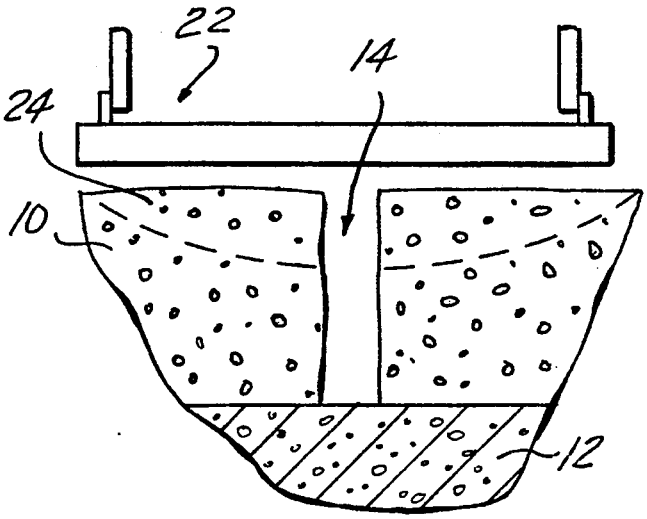
FIG. 2 is a schematic, cross sectional view showing the heating step of the present method.

As shown in FIG. 2, the next step in the present method is to heat the top portion of the asphalt pavement 10 surrounding the crack 14 to a predetermined temperature to soften the asphalt. A heating apparatus 22, preferably, a heating device appended to a vehicle, is placed a predetermined distance above the top surface of the asphalt pavement 10 so as to generate radiant heat to raise the temperature of the top portion of the asphalt pavement 10 to a predetermined temperature. A number of radiant heating vehicles are commercially available and may be used to practice the present method. A preferred vehicle is a vehicle sold by Thermal Power Corporation under the trademarks Patch Master, Heat Master, Thermal Master or Road Master road maintenance equipment. These devices are luminous wall heating devices whereby the heat is generated by the combustion of a gas/air mixture. The heating devices have a capability of heating the asphalt temperature from about 700° F. to about 1000° F. by virtue of the heating unit 22 being operable at a temperature between 1000° F. and 3000° F., with a preferable operating temperature of approximately 2000° F.

As a departure from prior asphalt road repair methods which use the application of heat to raise the temperature of the asphalt to only 325° F. to 350° F., according to the present method, sufficient heat is generated by the heating device 22 to raise the temperature of the top portion of the asphalt pavement 10 surrounding the crack 14 to greater than about 700° F. The actual temperature range for the heated asphalt is between about 700° F. and about 1000° F.

At these temperatures, if the top surface of the asphalt pavement 10 surrounding the crack 14 is raised to a temperature of approximately 1000° F, the temperature of the asphalt pavement approximately one quarter inch below the top surface will be at approximately 700° F., for example, the temperature one half inch below the top surface will be at approximately 400° F., and the temperature of the asphalt ¾ inches below the top surface will be at about 350° F. This softens the asphalt particles 24 in the asphalt pavement 10 and enables them to be loosened and moved about. It is important that the heating of the asphalt pavement 10 from 700° F. to 1000° F. be done while the pavement 10 is still in a solid layer form as loose asphalt particles are likely to ignite at these temperatures.

Figure 3:
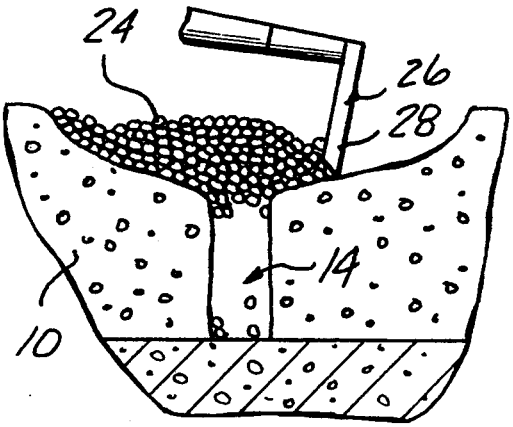
FIG. 3 is a schematic, cross sectional view showing the heated asphalt of step 2 being scarified.
Figure 4:
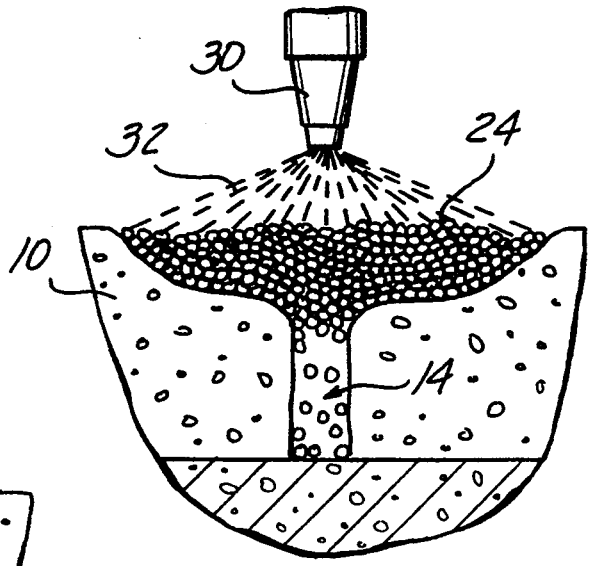
FIG. 4 is a schematic, cross sectional view showing the application of an asphaltic rejuvenating/emulsion agent to the heated, scarified asphalt.
Figure 5:
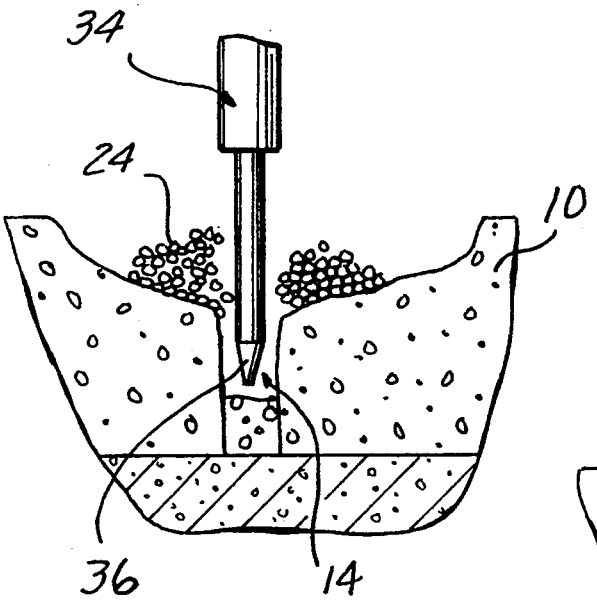
FIG. 5 is a schematic, cross sectional view showing the compacting of the heated, scarified asphalt and the asphaltic rejuvenating/emulsion agent into the full depth crack.

As shown in FIG. 3, the next step in the method of the present invention is to scarify the heated asphalt by using a conventional scarifying mechanism 26 having a scraping implement 28 which is drawn along the top surface of the asphalt pavement 10 to scrape, loosen and move about the heated, softened asphalt particles 24. Such scarifying can also be done manually by a rake. Although a certain number of the asphalt particles will fall into the crack 14, a large portion of the particles will remain on the top of the portion of the asphalt pavement 10 which has not received sufficient heat so as to be softened and scarified.

In the next step of the present method, a combined asphaltic rejuvenating/emulsion or bonding agent 32 is applied by means of a suitable spray device or nozzle 30. The asphaltic rejuvenating/emulsion agent 32 is preferably a combined rejuvenator and asphalt emulsion, such as one sold under the trade designation ST-100 by DAI, Springfield, Ohio or CRF sold by Witco Chemical. This asphaltic rejuvenating/emulsion agent contains a conventional petroleum based liquid asphalt rejuvenator and emulsified asphalt. The asphaltic rejuvenating-/emulsion agent 32 is sprayed over the loosened asphalt particles 24 on the asphalt pavement 10 surrounding the crack 14 and makes up for any deterioration which may have occurred in the asphalt 24 due to the high heating temperature of the asphalt.

According to the next step of the present method, the loosened asphalt particles 24 and the applied rejuvenating/emulsion agent 32 are driven under force into the crack 14 by means of a suitable compacting or tamping tool denoted generally by reference number 34. Such a tool 34 may be a hydraulically driven tool having a specially designed tip 36 which is provided in different widths and shapes to correspond to the particular width and shape of the crack 14. The tip 36 compacts or tamps a portion of the asphalt particles 24 coated with the second rejuvenating agent 32 into the crack 14.

Preferably, the step of heating the asphalt, adding the asphaltic rejuvenating/emulsion agent, scarifying the heat asphalt and compaction, the heated asphalt into the crack are performed as quickly as possible in order to maintain the temperature of the asphalt as high as possible.

Due to the extreme depth of full depth cracks in asphalt pavements 10, it is preferred that the compacting step described above be employed in increments of two to four inches each wherein a predetermined amount of loosened, asphalt particles 24 coated with the asphaltic rejuvenating/emulsion agent 32 is raked into the crack 14 and then compacted to a predetermined depth, such as three inches by the compacting tool 34. After the compacting tool 34 has been removed from the crack 14, additional quantities of the heated asphalt particles 24 are then raked into the crack to a predetermined depth, such as to correspond to an additional three inches of depth, and then compacted again. This process is repeated until the entire depth of the crack 14 has been filled with compacted, heated asphalt.

Figure 6:
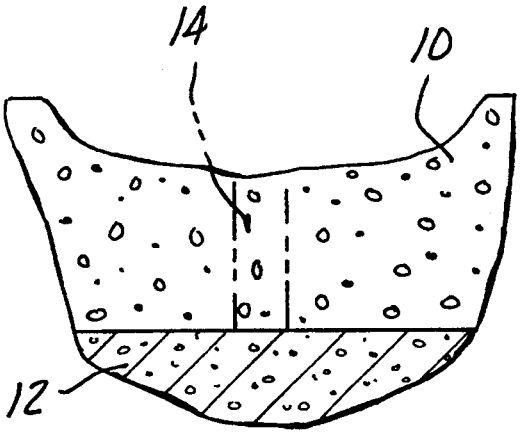
FIG. 6 is a cross sectional view showing the complete filling of a full depth crack.

During this compacting step, since the temperature of the asphalt particles 24 has been raised to a temperature of from 350° F. to 1000° F., the asphalt particles 24 have a high heat content, a portion of which is immediately transferred to the original, solid asphalt 10 surrounding the crack 14 along the entire depth of the crack. This heat softens and/or partially melts the original asphalt surrounding the crack 14 and enables a homogeneous weld or bond to be formed between the original asphalt surrounding the crack 14 and the heated, scarified asphalt coated with the asphaltic rejuvenating/emulsion agent 32 which is compacted into the crack 14. As shown in FIG. 6, this forms a continuous, homogeneous surface through the entire asphalt pavement 10, after the crack 14 has been completely filled with compacted asphalt particles 24, in which no original crack lines or boundaries exist.

Figure 7:
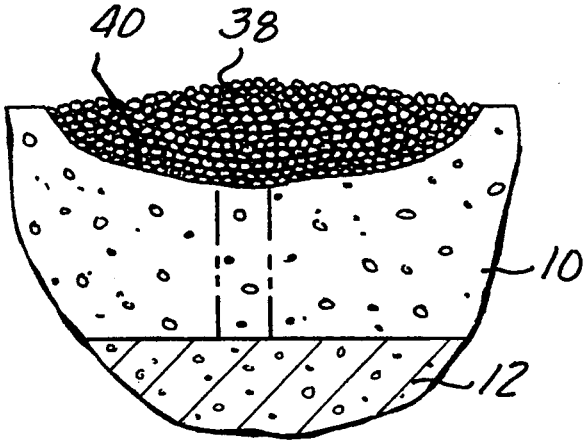
FIG. 7 is a cross sectional view showing the addition of new asphalt onto the pavement.
Figure 8:
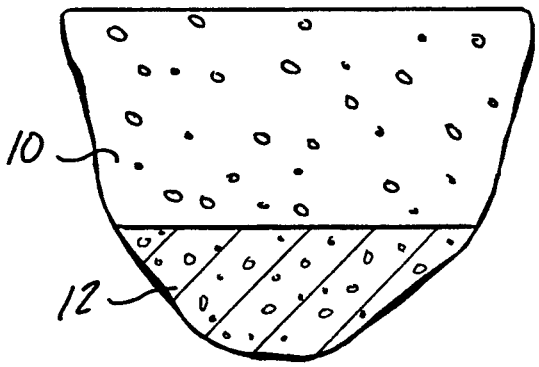
FIG. 8 is a cross sectional view showing the completed, repaired uniform asphalt pavement obtained by the present method.

If needed, as shown in FIG. 7, additional quantities of new asphalt 38 may be applied to the depression in the asphalt pavement 10 created by the scarifying and compacting of the asphalt particles 24 from the top surface of the asphalt pavement into the crack 14. The new asphalt 34 is then compacted and leveled to form a trafficable surface as shown in FIG. 8.

In summary, there has been disclosed a unique method for repairing full depth cracks in asphaltic pavement which ensures that such cracks which may extend substantially through the six to eight inches or more of the asphalt pavement, when filled with heated, scarified asphalt particles coated with an asphaltic rejuvenating-/emulsion agent, form a homogeneous bond with the surrounding asphaltic pavement.

What is claimed is:

1. A method for repairing a full depth crack in an asphaltic pavement in which the crack extends substantially the full depth from the top surface to the underlying base of the asphalt pavement, the method comprising the steps of:

spraying an asphaltic rejuvenating liquid agent into the sides of the crack for the full depth of the crack and over the portions of the asphaltic pavement immediately surrounding the edges of the crack;

heating the top portion of the asphalt pavement surrounding the crack to a temperature greater than about 700° F.;

scarifying the heated asphalt immediately adjacent the crack;

adding an asphaltic rejuvenating/emulsion agent to the scarified, heated asphalt;

compacting the heated asphalt and the asphaltic rejuvenating/emulsion agent into the full depth of the crack wherein the heated asphalt transfers heat to the original asphalt surrounding the crack to raise the temperature of the original asphalt surrounding the crack so as to form a homogeneous bond between the heated asphalt and the original asphalt.

2. The method of claim 1 further comprising the steps of:

adding new asphalt to the top surface of the asphalt pavement after the crack has been completely filled; and leveling the new asphalt to form a trafficable surface on the asphalt pavement.

3. The method of claim 1 wherein the step of heating the asphalt is performed before the step of scarifying the asphalt.

4. The method of claim 1 wherein:

the steps of heating the asphalt, adding the asphaltic rejuvenating/emulsion agent, scarifying the heated asphalt, and compacting the heated asphalt into the crack are done in a short period of time to maintain the temperature of the heated asphalt as high as possible.

5. The method of claim 1 wherein the step of heating the asphalt is performed by a radiant heater operating at a temperature between 1000° F. and 3000° F.

6. The method of claim 1 wherein the step of heating the asphalt comprises the step of:

heating the top portion of the asphalt to a temperature between about 700° F. to about 1000° F.

7. The method of claim 1 wherein the step of compacting the heated asphalt into the crack comprises the step of:

compacting a predetermined amount of heated asphalt in the crack to fill the crack to a predetermined depth less than the full depth of the crack; and repeatedly adding a predetermined amount of heated asphalt and compacting each predetermined amount of heated asphalt in the crack until the full depth of the crack is filled with compacted asphalt.

* * * * *